United States Patent [19]

Kraft et al.

[11] Patent Number: 4,957,129

[45] Date of Patent: Sep. 18, 1990

[54] FLUID REMOVING APPARATUS

[75] Inventors: Kenneth N. Kraft; R. Craig Allen, both of Evansville; Larry J. Schenk, Mount Vernon, all of Ind.

[73] Assignee: George Koch Sons, Inc., Evansville, Ind.

[21] Appl. No.: 294,274

[22] Filed: Jan. 6, 1989

[51] Int. Cl.[5] ..... B08B 3/02

[52] U.S. Cl. ..... 134/151; 134/199

[58] Field of Search ..... 139/82, 144, 151, 152, 139/153, 166 R, 167 R, 172, 198, 199

[56] References Cited

U.S. PATENT DOCUMENTS

| | | | |
|---|---|---|---|
| 2,166,250 | 7/1939 | Herman . | |
| 2,289,967 | 7/1942 | Johnson et al. | 134/151 X |
| 2,764,171 | 9/1956 | Nolte | 134/152 X |
| 2,988,459 | 6/1961 | Buelow et al. . | |
| 3,722,462 | 3/1973 | Pohler et al. . | |
| 3,902,513 | 9/1975 | Franz | 134/151 |
| 3,968,279 | 7/1976 | Brown et al. . | |
| 4,013,038 | 3/1977 | Rogers et al. . | |
| 4,102,350 | 7/1978 | Chelton et al. | 134/152 X |
| 4,133,340 | 1/1979 | Ballard | 134/152 X |
| 4,153,006 | 5/1979 | Thornton et al. . | |
| 4,347,805 | 9/1982 | Ernest . | |
| 4,383,961 | 5/1983 | Nyman et al. | 134/199 X |
| 4,664,308 | 5/1987 | Boynton . | |

*Primary Examiner*—Philip R. Coe

*Attorney, Agent, or Firm*—Barnes & Thornburg

[57] ABSTRACT

An apparatus is provided for removing excess fluid from an acticle. A spray nozzle is used to discharge a high pressure liquid stream across a predetermined area of a housing. An article including a top surface having an upwardly-turned outer edge forming a cavity which contains excess fluid is transported through the high pressure liquid stream. The high pressure liquid stream is directed at the top surface of the article to force the excess fluid from the cavity.

8 Claims, 2 Drawing Sheets

FLUID REMOVING APPARATUS

BACKGROUND AND SUMMARY OF THE INVENTION

This invention relates to devices and methods for removing excess fluid from articles during a finishing process. More particularly, the invention relates to the use of a high pressure liquid spray to remove excess fluid located on the exterior surface of the article.

In a typical multi-step finishing process, articles are spraYed with various cleaning solutions during the finishing process. The articles are typically conveyed into a cleaning stage and sprayed with the cleaning solution and then conveyed out of that particular stage.

Each cycle of spraying the articles with the cleaning solution comprises one cleaning step. Several cleaning steps are used during a typical finishing process. Each cleaning step is followed by a rinse step so that excess cleaning solution can be removed from the article prior to a subsequent cleaning step. A conveyor then transports the article to the next cleaning stage to proceed with the next cleaning step.

Rinsing of the articles occurs in a rinse stage or sPray wash booth and serves to reduce carryover of cleaning solution between separate solution tanks. A common Problem with such rinse operations is that excess rinsing fluid may be retained on the exterior surface of the article as the article exits the rinse operation. This is particularly a problem for articles having upwardly turned edges which form cavities on the top surface of the article because such a configuration permits substantial retention of excess rinsing fluid. The excess fluid can be carried to a subsequent solution tank causing contamination of the subsequent cleaning solution which is undesirable.

In addition to being desirable to prevent contamination of the cleaning solution, removal of excess fluid from the exterior surface of articles is necessary when containment of the cleaning solution is required. Many cleaning solutions are highly toxic, and containment of the cleaning solution may be required for environmental reasons. In addition, cleaning solutions are often expensive. Therefore, the overally cost of cleaning the article can be reduced if excess cleaning solution is recovered and reused.

Excess fluid on the exterior surface of articles also increases the time and energy required to dry the articles after the finishing process is complete. When a drying operation follows a rinse step, it is desirable to minimize the excess fluid retained on the exterior surface of the articles in order to save drying time and energy costs.

It is known in the art to use water sprays for rinsing a cleaning solution from an article. It is also known in the art to use forced air to remove fluid from the exterior surface of articles after the articles have been rinsed. The present invention increases the efficiency of removing excess fluid from articles by utilizing a high pressure liquid spray to force the excess liquid off the article.

One object of the present invention is to eliminate solution carryover on the exterior surface of articles from one finishing step to the next to prevent contamination of separate tanks of cleaning solution used in a multi-step finishing process.

Another object of the present invention is to reduce excess fluid on the exterior surface of an article prior to drying the article to reduce the time and energy required to dry the article.

According to the present invention, an apparatus is provided for removing excess fluid from an article. The apparatus includes a housing, means for spraying a high pressure liquid stream across a predetermined area inside the housing, and means for supplying liquid to the spraying means. The apparatus further includes means for transporting the article having excess fluid on a portion of its exterior surface through the housing so that the portion of the exterior surface of the article having excess fluid thereon passes through the high pressure liquid stream. The high pressure liquid stream forces substantially all the excess fluid off the outer surface of the article.

In preferred embodiments, the spraying means includes a spray nozzle coupled to a liquid supply pipe. A pump forces the liquid through the supply pipe and nozzle at a predetermined discharge pressure. The pressure is selected to be high enough so that the liquid spray forces excess fluid from exterior cavities formed on the article without refilling the cavities with liquid from the fluid removing apparatus. As the article is transported past the high pressure liquid spray, the liquid spray sweeps substantially all the excess fluid from the exterior surface of the article. The velocity of the liquid spray is high enough so that only a small quantity of the liquid remains on the article's exterior surface after the article passes through the high pressure liquid spray.

One feature of the invention is the provision of a high pressure liquid spray nozzle positioned so that articles are transported through the high pressure liquid spray from the nozzle after the articles have been sprayed with a cleaning solution and rinse. Advantageously, such a configuration removes substantially all the excess rinsing fluid from the exterior surface of the articles, thereby minimizing the risk of contamination of cleaning solution in a subsequent solution tank and reducing the time and energy required to dry the articles.

Additional objects, features, and advantages of the invention will become apparent to those skilled in the art upon consideration of the following detailed description of a preferred embodiment exemplifying the best mode of carrying out the invention as presently perceived.

BRIEF DESCRIPTION OF THE DRAWINGS

The detailed description particularly refers to the accompanying figures in which.

DETAILED DESCRIPTION OF THE INVENTION

Figure 1:
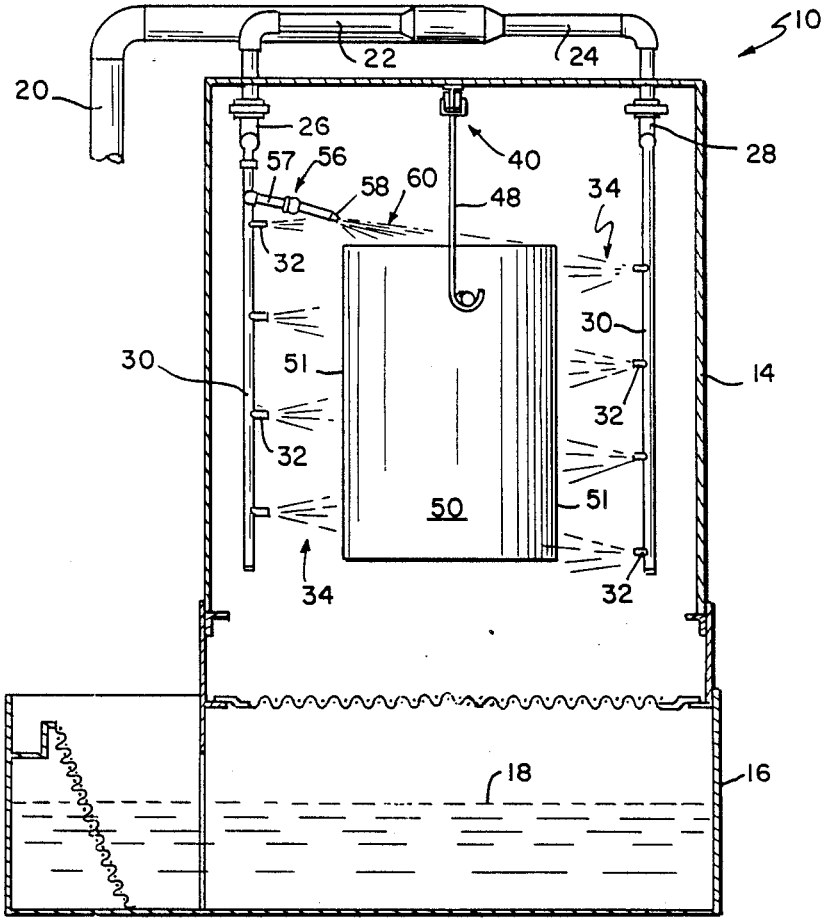
FIG. 1 is an elevational view in section of a spray wash booth illustrating the position of the fluid removing apparatus of the present invention.
Figure 2:
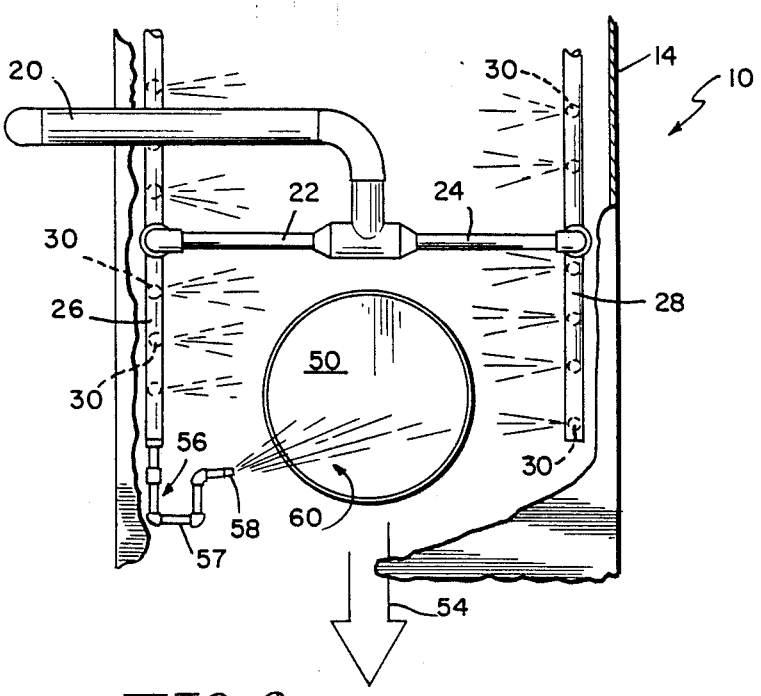
FIG. 2 is a top plan view of the spray wash booth shown in FIG. 1.

Referring to FIGS. 1–2, a spray wash booth 10 is shown which includes a housing 14 mounted above a tank 16 containing a spray wash fluid 18 which may preferably be water. A pump (not shown) forces the fluid 18 from tank 16 through pipe 20. Pipe 20 supplies the spray wash fluid 18 to first crossover pipe 2 and second crossover pipe 24 which pass into the housing 14 through inlet ports (not shown). First crossover pipe 22 is coupled to a first fluid manifold 26, and second cross over pipe 24 is coupled to a second fluid manifold 28.

First and second fluid manifolds 26 and 28 include a plurality of downwardly extending riser tubes 30. Each of the riser tubes 30 includes a plurality of spray nozzles 32. Ideally the spray nozzles 32 are conventional fluid spray nozzles with an orifice diameter of 13/64 of an inch Spray nozzles 32 may illustratively be Veejet type H-3/8 U5070 nozzles which are available from Delavan.

A conveyor 40 is provided to transport an article 50 through the housing 14 in the direction of arrow 54 shown in FIG. 2. The article is suspended from the conveyor 40 by hangers 48.

The spray wash booth 10 further includes a fluid removing apparatus 56. The fluid removing apparatus 56 according to the present invention is attached to manifold 26. The fluid removing apparatus 56 includes a jointed segment 57 coupled at one end to manifold 26 and at the other end to a nozzle 58. Ideally, nozzle 58 is a flat fan nozzle which will produce a uniform flat spray pattern 60. Nozzle 58 may illustratively be a WFM-70 flat spray nozzle available from Delavan.

Operation of the spray wash booth 10 is initiated when an article 50 covered with cleaning solution is transported into the booth 10 on hangers 48 by the conveyor 40. A pump (not shown) pumps the fluid 18 from the tank 16 to the spray nozzles 32 which direct fluid streams 34 to the sideward facing surface 51 of article 50. The article 50 either remains stationary inside spray wash booth 10 for a specified period of time, or is continuously transported through housing 14 to remove cleaning solution from the exterior surface of article 50.

Figure 3:
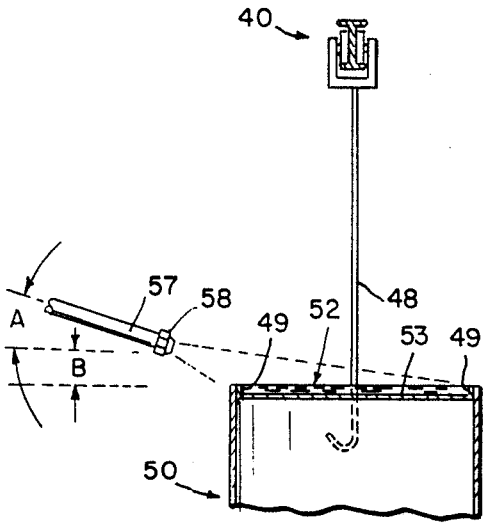
FIG. 3 is a view similar to FIG. 1 showing the article in section and illustrating the position of the spray nozzle with respect to the article.

At the end of the specified time period, valves (not shown) shut off the flow of fluid 18 to the spray nozzles 32 and direct flow of the fluid 18 to the fluid removing apparatus 56. It will be understood that excess rinsing fluid can remain on the exterior surface of article 50 after the rinse step is complete. This is particularly a problem if the article 50 has an upwardly-turned edge similar to edge 49 on top surface 53 as shown in FIG. 3. After the rinse step is complete, the conveyor 40 transports the article 50 past the fluid removing apparatus 56 and out of spray wash booth 10. As the article 50 moves past fluid removing apparatus 56, the portion of the article 50 that contains excess fluid is oriented to pass through the liquid spray 60 from nozzle 58.

The operation of the fluid removing apparatus 56 is illustrated in detail in FIGS. 3–6*b*. As illustrated in FIG. 3, the article 50 includes an upwardly turned edge 49 which forms a cavity on the top surface 53 of article 50. Excess solution 52 collects inside the cavity and is removed by the fluid removing apparatus 56 as the article 50 exits spray wash booth 10.

Nozzle 58 is angled downwardly with respect to a plane that is parallel to the upper surface 53 of article 50 as illustrated by angle A in FIG. 3. Angle A may preferably be around 17 degrees. Nozzle 58 is located to a specified height above the top surface 53 of article 50 as illustrated by dimension B. Dimension B may preferably be approximately 3 inches. The nozzle 58 may preferably be spaced apart from article 50 by approximately 2 to 5 inches depending upon the size of article 50.

Figure 4:
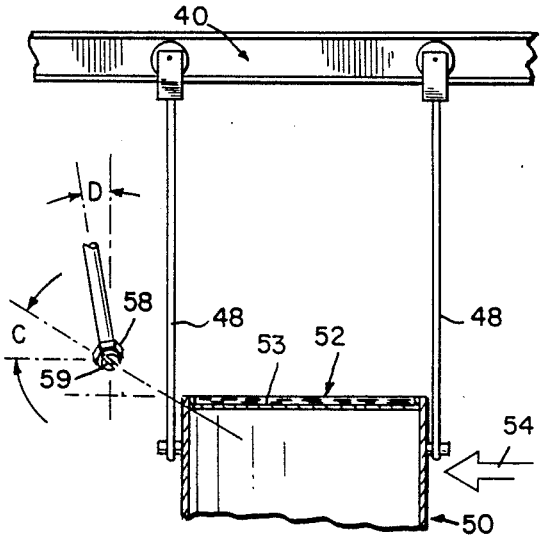
FIG. 4 is a side elevational view of FIG. 3 further illustrating the position of the spray nozzle.

Referring now to FIG. 4, nozzle 58 may preferably be angled approximately 10 degrees toward the oncoming article 50 with respect to a transverse plane through booth 10 as illustrated by angle D. In addition, the rectangular aperture 59 of nozzle 58 may preferably be rotated approximately 30 degrees with respect to a plane parallel to the upper surface 53 of article 50 as illustrated by angle C. It will be understood that dimensions A, B, C, and D may preferably be optimal conditions for the solution removal apparatus 56. This arrangement appears to produce the most beneficial results, but variations of these dimensions may still produce satisfactory results.

The jointed segment 57 permits the orientation of the nozzle 58 to be changed to a different height, angle, or distance from the article 50. Depending upon the size and configuration of article 50, different orientations of the jointed segment 57 may be advantageous to optimize performance of the fluid removing apparatus 56.

Figure 5B:
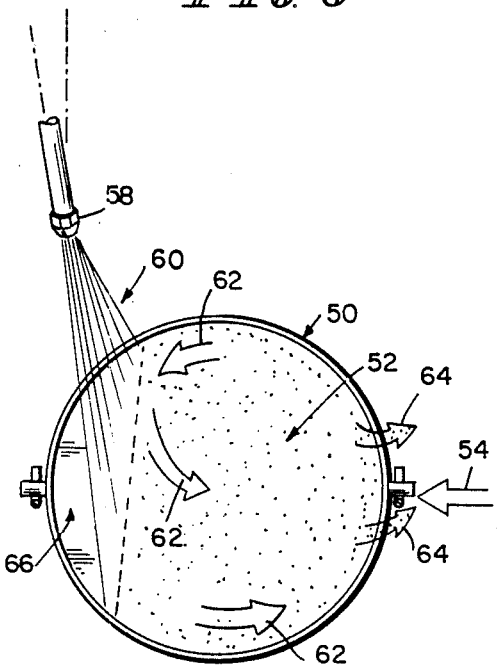
FIG. 5*b* is a top plan view of FIG. 5*a;*
Figure 5A:
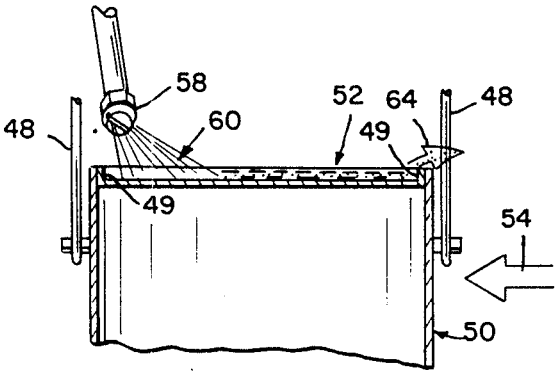
FIG. 5*a* is an enlargement of a portion of FIG. 4 illustrating the operation of the fluid removing apparatus.

Referring to FIGS. 5*a* and 5*b*, as the article 50 is transported in the direction of arrow 54, the top surface of the article 50 containing excess fluid 52 passes through the high pressure spray 60. The high pressure spray 60 forces the excess solution 52 to rotate in the direction of arrows 62. As the article 50 continues to move in the direction of arrow 54, a substantial portion of the excess fluid 52 is forced over the upwardly-turned edge 49 of article 50 as illustrated by arrows 64.

The high pressure liquid spray 60 preferably has a discharge velocity great enough to sweep the excess fluid 52 off the top surface 53 of article 50 without refilling the cavity with liquid from the fluid removing apparatus 56. For instance, the nozzle 58 may discharge the liquid at 20 p.s.i., but it may be possible to increase or decrease the discharge pressure and still obtain satisfactory results. A portion 66 of the top surface 53 which has passed the high pressure liquid spray 50 is substantially free of excess solution.

Figure 6B:
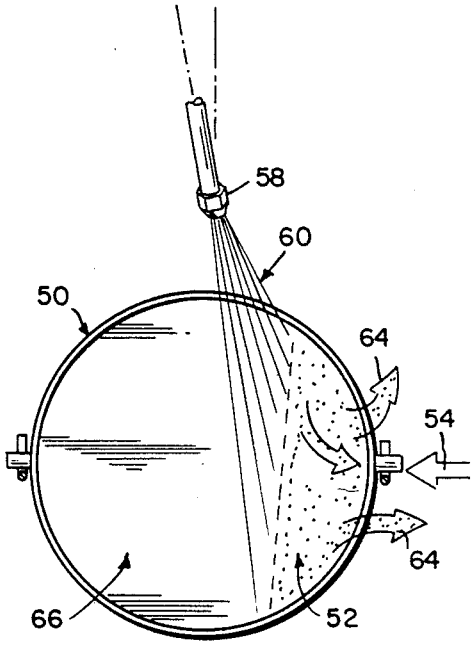
FIG. 6*b* is a top plan view of FIG. 6*a*.
Figure 6A:
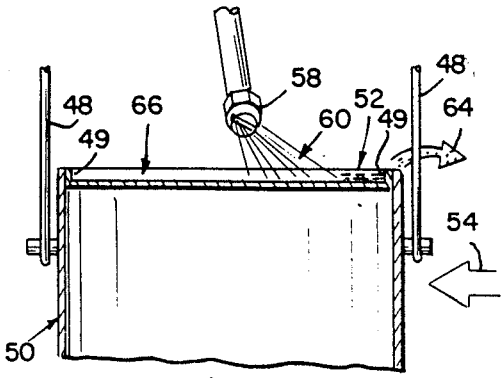
FIG. 6*a* is a view similar to FIG. 5*a* with the article advanced further relative to the spray nozzle.

FIGS. 6*a* and 6*b* illustrate the operation of the fluid removing apparatus 56 after the article 50 has been transported further in the direction of arrow 54 relative to nozzle 58. The portion 66 of the top surface 53 of article 50 which has passed the high pressure spray 60 is substantially free of excess solution. The remaining excess solution 52 is forced overupwardly turned edge 49 of article 50 as illustrated by arrows 64.

FIG. 6*a* illustrates the reduced volume of liquid in portion 66 of the top surface 53 which has passed the high pressure liquid spray 60. As article 50 moves completely past spray 60, only a small quantity of liquid is retained on top surface 53 of article 50. This small quantity of liquid remaining is not significant enough to cause contamination of finishing solution in a subsequent finishing tank or to substantially increase the time and energy necessary to dry the article 50.

Although the invention has been described in detail with reference to a preferred embodiment, variations and modifications exist within the scope and spirit of the invention as described and defined in the following claims.

What is claimed is:

1. An apparatus for removing excess solution from an article comprising a housing, means for spraying a high pressure liquid stream across a predetermined area inside the housing, the spraying means including a nozzle coupled to a liquid supply pipe, means for supplying liquid to the spraying means, and means for transporting an article having excess fluid on a portion of its exterior surface through the housing so that the portion of the exterior surface of the article having excess fluid thereon passes through the high pressure liquid stream, with the high pressure liquid stream forcing substantially all the excess fluid off the exterior surface of the article, the article including a top surface having an upwardly-turned outer edge forming a cavity which contains the excess fluid, the high pressure liquid stream being directed at the top surface of the article to force the excess fluid from the cavity as the article passes through the high pressure liquid stream.

2. The apparatus of claim 1, wherein the nozzle is angled downwardly at about 17 degrees with respect to the top surface of the article and angled about 10 degrees toward the approaching article with respect to a transverse plane through the housing.

3. The apparatus of claim 1, wherein the nozzle provides a flat spray pattern, the nozzle being rotated about its longitudinal axis so that the flat spray pattern is angled by about 30 degrees with respect to the top surface of the article.

4. The apparatus of claim 1, wherein the nozzle discharges the liquid at a discharge pressure of at least 20 pounds per square inch.

5. An apparatus for removing excess finishing solution from an article comprising a housing, means for transporting an article from an upstream portion to a downstream portion of the housing, means rinsing the article as the article passes through the housing, and a spray nozzle situated downstream from the rinsing means for providing a high pressure liquid stream across a predetermined region of the housing so that the article passes through the high pressure liquid stream to remove excess rinsing liquid from the exterior surface of the article, the article including a top surface having an upwardly-turned outer edge forming a cavity which collects excess rinsing liquid, the high pressure liquid spray being directed at the top surface of the article to force the excess rinse liquid from the cavity as the article passes through the high pressure liquid spray.

6. The apparatus of claim 5, wherein the nozzle is angled downwardly at about 17 degrees with respect to the top surface of the article and angled about 10 degrees toward the upstream portion of the housing with respect to a transverse plane through the housing.

7. The apparatus of claim 5, wherein the nozzle provides a flat spray pattern, the nozzle being rotated about its longitudinal axis so that the flat spray pattern is angled by about 30 degrees with respect to the top surface of the article.

8. The apparatus of claim 5, wherein the nozzle discharges the liquid at a discharge pressure of at least 20 pounds per square inch.

* * * * *